United States Patent [19]

Burns, Jr.

[11] 4,061,006

[45] Dec. 6, 1977

[54] METHOD OF STRAIGHTENING FIREARM BARRELS

[75] Inventor: Arthur H. Burns, Jr., Hamden, Conn.

[73] Assignee: The Marlin Firearms Company, North Haven, Conn.

[21] Appl. No.: 709,778

[22] Filed: July 29, 1976

[51] Int. Cl.[2] ..... B21D 3/16

[52] U.S. Cl. ..... 72/34; 72/369

[58] Field of Search ..... 72/33, 34, 369, 380, 72/384

[56] References Cited

U.S. PATENT DOCUMENTS

| | | | |
|---|---|---|---|
| 795,300 | 7/1905 | Nichols | 72/34 |
| 1,551,715 | 9/1925 | Urschel | 72/33 |

*Primary Examiner*—Lowell A. Larson

*Attorney, Agent, or Firm*—Walter Spruegel

[57] ABSTRACT

To straighten firearm barrels with bores running out to muzzle ends, a barrel is bent at a transverse barrel plane at a distance of less than half the barrel length from the muzzle end to an extent and in a direction to bring the bore center axis at this barrel plane into line with a straight reference axis passing through the centers of the opposite bore ends.

9 Claims, 15 Drawing Figures

20
22
26
96
x
x'
z'
42'
34
102
104
100
36
42
46
50
24
56
54
4

METHOD OF STRAIGHTENING FIREARM BARRELS

This invention relates to the manufacture of firearm barrels in general, and to a method of straightening firearm barrels in particular.

In producing firearm barrels, is is customary to machine the bores into solid barrel blanks in a deep-drilling operation which is characteristic for some lateral creep of the drill in its advance in a blank due to differing hardness of the steel stock of the blank and also other factors, with the result that the average bore thus drilled in barrels runs out, i.e., deviates from true rectilinear disposition more or less slightly, but nevertheless sufficiently to require in almost all cases straightening of the bore for its expected firing accuracy. To straighten the bores of barrels, which is commonly referred to as "straightening barrels", the barrels are customarily bent under the control of operators with a view toward bringing the bores into closest possible rectilinear disposition, with the operators resorting to several expediencies in gauging the location, direction and extent of bends to be made in barrels under their control.

While operators are able to straighten barrels with the help of these expediencies, the latter also have some severe limitations. To begin with, resort to these expediencies with the expectation to straighten a barrel bore is an error in principle, for it is highly unlikely that a few, and mostly no more than two, corrective bends in a barrel will straighten the entire bore. Instead, the most that can be expected from an operator with the help of these expediencies is sufficient partial straightening of a barrel bore to bring its firing accuracy within acceptable standards. Even more important, while these expediencies do afford to operators some indication of the run-out condition of barrel bores, they do not afford any positive and unmistakable guide as to the exact location. direction and extent of the bends to be made in barrels for a predictable response of the latter in a straighter bore, wherefore it is largely good judgement on the part of rather highly skilled and experienced operators which gives them some insight as to proper control over bends in barrels with reasonable expectation of barrel response in a straighter bore and thereby keeps the straightening of barrels out of the category of out-and-out trial procedures.

It is among the objects of the present invention to devise a method of straightening firearm barrels, according to which a single corrective bend in most barrels will succeed in adjusting the disposition of the bore therein such that its firing accuracy will be substantially as high as that of a bore which is truly rectilinear over its entire length. To this end, and pursuant to my discovery that a barrel will have such high firing accuracy if no more than a relatively short endlength of its bore to and including its muzzle end is straight and in line with a reference axis of the bore which passes through the exact centers of the opposite bore ends, the method provides for applying the single bend in a barrel at a relatively short distance from the muzzle end. The relatively short endlength of the bore of a barrel to be thus straightened, while being in most cases more or less inclined to the reference axis of the bore due to run-out of the latter in deep-drilling, is nevertheless mostly straight over its expanse, so that an abrupt bend in a barrel at the indicated location in the right direction and of the correct extent will leave this endlength of the bore intact in its straight expanse, but bring it into line with the reference axis of the bore.

It is another object of the present invention to devise a method of straightening firearm barrels which also provides for subjecting each barrel to a simple and quick test procedure by an operator which positively and unmistakably indicates to him the right direction and correct extent of the aforementioned single bend to be made in each barrel and enables him to proceed with bending each barrel with despatch and straighten the same to the high firing accuracy referred to. To that end, the test procedure involves inserting in a barrel bore from the muzzle end thereof a rod with a slide fit to a depth not to exceed the aforementioned relatively short distance from the muzzle end, with a length of the rod being left projecting from the muzzle end of the bore, supporting the barrel for rotation about the aforementioned reference axis of the bore, and turning the supported barrel while holding the rod agaist rotation for motion response of the projecting rod length in an orbital path of which certain characteristics are unmistakably indicative of the right direction and the correct extent of the bend to be made in the barrel at the given distance from the muzzle end. Thus the orbital path in which the forward rod length moves is in the shape of a cone the taper of which indicates the inclination of the rod-holding forward bore length to the reference axix and the bore and, hence, is a reliable medium from which to gauge the correct extent of the corrective bend in the barrel. Further, this orbital path is also a reliable medium from which to gauge the correct lateral direction in which the barrel is to be bent, with this direction lying in a reference plane of the barrel in which lie the reference axis of the barrel bore and the therewith coextensive axis of the cone-shaped orbital path as well as the projecting rod length in its inclination to these axes.

It is a further object of the present inventon to devise a method of staightening firearm barrels in which the aforementioned test procedure with each barrel is carried out in an installation providing bearing means and a bending ram, of which the bearing means are adapted for the rotary support of a barrel about the reference axis of its bore, and are arranged in association with the ram for bending a supported barrel at the prescribed distance from the muzzle end, with the installation further providing an instrument which is actuated by the aforementioned projecting rod length on a supported barrel on its orbital movement to give a readable indication not only of the inclination of this rod length to the reference axis of the barrel bore, but also the angular position of the barrel in which rotation of the same is to be stopped because the barrel is then in the right position in which the ram will on its work stroke bend the barrel in the right direction.

Further objects and advantages will appear to those skilled in the art from the following, considered in conjunction with the accompanying drawings.

In the accompanying drawings:

FIG. 8 is a part-sectional and part-elevational view of the installation similar to FIG. 2 but showing it in a different operating position;

Figures 1, 2, 2A, 2B, 2C:
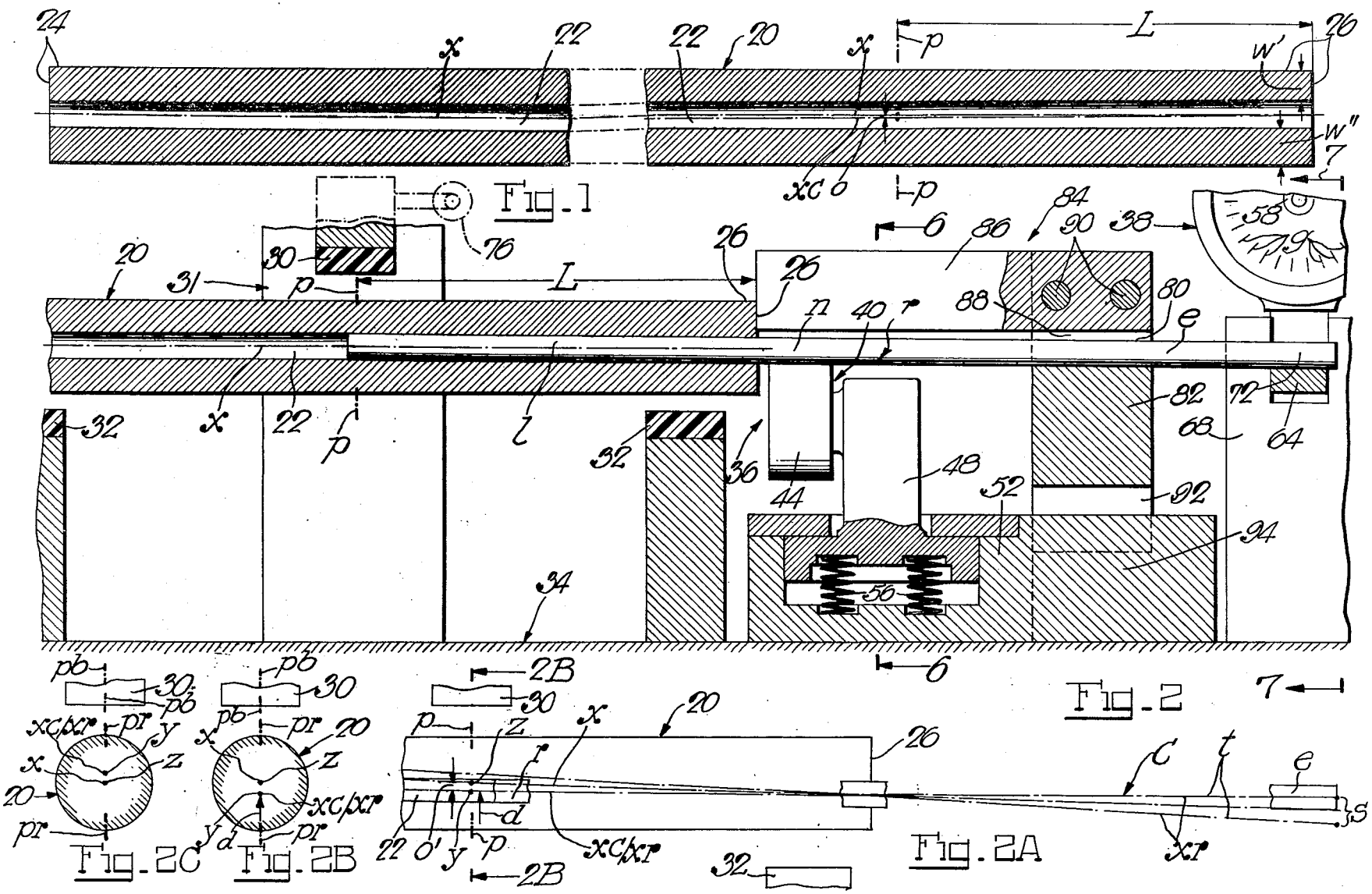
FIG. 1 is a section through a barrel which requires straightening.
FIG. 2 is a fragmentary view of an installation in which to straighten a barrel according to a method of the invention.
FIG. 2A is a diagrammatic view of a barrel while subjected to a certain test procedure.
FIG. 2B is a section substantially on the line 2B—2B of FIG. 2A.
FIG. 2C is a section similar to that of FIG. 2B.

Referring to the drawings, FIG. 1 shows a typical firearm barrel 20 with a bore 22 which is customarily formed by deep-drilling. In this instance, and according to more common practice, the bore 22 has been drilled from the butt end of the barrel centrally thereof, wherefore the bore is rightfully presumed to be, and usually is, concentric with the barrel at its butt end. Having been formed by deep-drilling, however, it is an inherent characteristic of the bore that the same runs out starting somewhere away from the butt end 24 and usually continuing to the muzzle end 26 of the barrel, because the drill will on its advance in the barrel have some lateral creep from a true rectilinear course therethrough. Run-out of the bore 22 at the muzzle end 26 of the barrel and, hence, the eccentricity of the bore end thereat is indicated by the different opposite wall thicknesses w' and w'' thereat, though run-out of the bore in actual barrels in usually less, so that eccentricity of the bore end at the muzzle end of the barrel is not readily perceptible with the naked eye. The axis $x$ is a reference axis of the bore 22 which extends straight and passes through the centers of the opposite bore ends, namely the concentric bore end at the butt end 24 of the barrel and the eccentric bore end at the muzzle end of the barrel. This reference axis $x$, by being straight and passing through the centers of the opposite concentric and eccentric bore ends, is neither the true center axis of the barrel, nor the true center axis of the barrel bore which cannot be straight because of the explained run-out of the bore.

As already mentioned, I have discovered that a barrel having a drilled bore with some run-out to the muzzle end of the barrel will have entirely satisfactory firing accuracy if no more than a relatively short endlength of the bore to the muzzle end of the barrel is straight and in line with the described reference axis $x$ of the bore. In FIG. 1, L represents such a relatively short endlength of the barrel bore which, while usually substantially straight over its longitudinal extent, is by virtue of its run-out condition inclined to the reference axis $x$ as indicated by the exemplary offset o of the true center axis $xc$ of the bore at the inner end of the bore length L from the reference axis $x$. Therefore, the barrel 20 will have entirely satisfactory firing accuracy if the center axis xc of the length L of the barrel bore 22 is brought into substantial alignment with the reference axis $x$ by an appropriate bend in the barrel at its transverse plane p. A bend in the barrel appropriate to that end, besides being preferably a rather abrupt bend centered on the transverse barrel plane at the selected distance from the muzzle end of the barrel, will have to be of an extent for displacement of the barrel at the plane $p$ relative to the bore reference axis $x$ thereat, over a distance substantially equal to $o$, and will have to be in a direction such that the center axis $xc$ of the bore length L is brought into substantial alignment with the reference axis $x$. While the location of the transverse plane of a barrel at which a corrective bend is to be made is selectible, and is to be at a distance of less than half, and preferably about one-fourth, of the barrel length from the muzzle end, this plane location, once selected, is kept for all like barrels that are to be straightened.

As to the correct extent and direction of the bends to be made in barrels, indications thereof are obtained by subjecting each barrel to a quick and simple test procedure. This test procedure involves inserting a slidingly fitting length 1 of a straight rod r into the bore 22 of a barrel over the length L thereof, i.e., to the transverse barrel plane $p$ (FIG. 2), while leaving a fairly long end part e of the rod r projecting from the muzzle end 26 of the barrel, and turning the barrel, preferably manually, about the reference axis $x$ of its bore while holding the rod r against rotation for ensuing motion response of the projecting rod part e in an orbital path in the shape of a cone. It is this motion response of the projecting rod part e in a cone-shaped orbital path which affords an indication of the correct extent of a bend to be made in a barrel and also an indication of the correct direction of such bend. For a clearly perceptible demonstration of the orbital path of a projecting rod part e on a barrel 20, reference is had to FIG. 2A which shows diagrammatically a barrel bore 22 of exaggerated run-out not only at the muzzle end 26 of the barrel, but also at the transverse plane p where the center axis $xc$ of the bore and, hence, also the rod axis xr are offset from the reference axis $x$ of the barrel bore by the exaggerated amount $o'$, all to the end of demonstrating an orbital path of the projecting rod part in the shape of a cone C which is sufficiently stubby to exhibit a taper $t$, or a base $s$ of correspondingly large diameter, both of which are clearly perceptible, with this cone C being in this instance defined in FIG. 2A by the rod axis $xr$ in diametrically opposite positions thereof in its orbital path. Thus, the taper $t$, even more so the far more readily perceptible operational deflection of the end of the projecting rod part $e$ which defines the base $s$, of the cone C, is a reliable medium from which to gauge the correct extent of the bend in the barrel at the transverse plane $p$ thereof, with the extent of such a corrective bend being in this example substantially over the distance $o'$ (FIG. 2A).

The orbital cone-shaped path of the projecting rod part is also a reliable medium from which to gauge the correct direction in which the barrel is to be bent. Thus, and with reference to FIGS. 2A and 2B, it will be noted that the points $y$ and $z$ of the bore center axis $xc$ and bore reference axis $x$, respectively, at the transverse barrel plane $p$ lie also in a plane pr (FIG. 2B) which is a reference plane of the barrel in which further lie the bore reference axis $x$ and the rod axis $xr$ and, hence, also the projecting rod part $e$. Accordingly, the corrective bend in the barrel for bringing the point *y* of the bore center axis *xc* at the transverse barrel plane *p* into alignment with the bore reference axis *x* (FIG. 2A) must be kept in the reference plane *pr* of the barrel in any event (FIG. 2B). Further, the corrective bend must also be in a direction *d* in this reference plane *pr* in order to displace the point *y* of the bore center axis *xc* toward and into alignment with the point *z* of the bore reference axis *x*. Therefore, to make the corrective bend in the barrel 20 by means of a power ram, the barrel is coordinated with such a ram 30 in the examplary manner of FIGS. 2A and 2B insofar as the barrel is beneath the ram, and the ram is also in operative alignment with the transverse barrel plane *p* (FIG. 2A) for bending the barrel at this plane. However, if the barrel 20 in the examplary angular position of FIG. 2A and 2B were bent at the transverse plane *p* thereof on a downstroke of the ram 30 in its exemplary plane of reciprocation pb, the ensuing bend in the barrel would displace the point *y* of the bore center axis *xc* downwardly, i.e., even further away from the point *z* of the bore reference axis, as will be readily understood. Accordingly, in order to bend the barrel correctly on an examplary downstroke of the ram 30, the barrel must first be displaced 180° from the angular position in FIGS. 2A and 2B into the angular position in FIG. 2C so that the point *y* of the bore center axis *xc* will be above the point *z* of the bore reference axis *x* and the point *y* will then be displaced downwardly, i.e., correctly, into alignment with the bore reference axis *x* on a downstroke of the ram 30 in the course of which the ram will first depress the barrel into backing engagement with two anvils 32 on opposite sides of the ram, whereupon the latter will on its continued descent apply the corrective bend to the barrel.

Subjection of barrels to the explained test procedure and applying corrective bends thereto preferably takes place in an installation which has as its major components a base 34, a bearing-type barrel support 36 (FIGS. 2 and 3), a barrel bending ram 30 on a press 31 and associated anvils 32, and a bore run-out indicating instrument 38.

Figures 5, 6, 7, 7A:
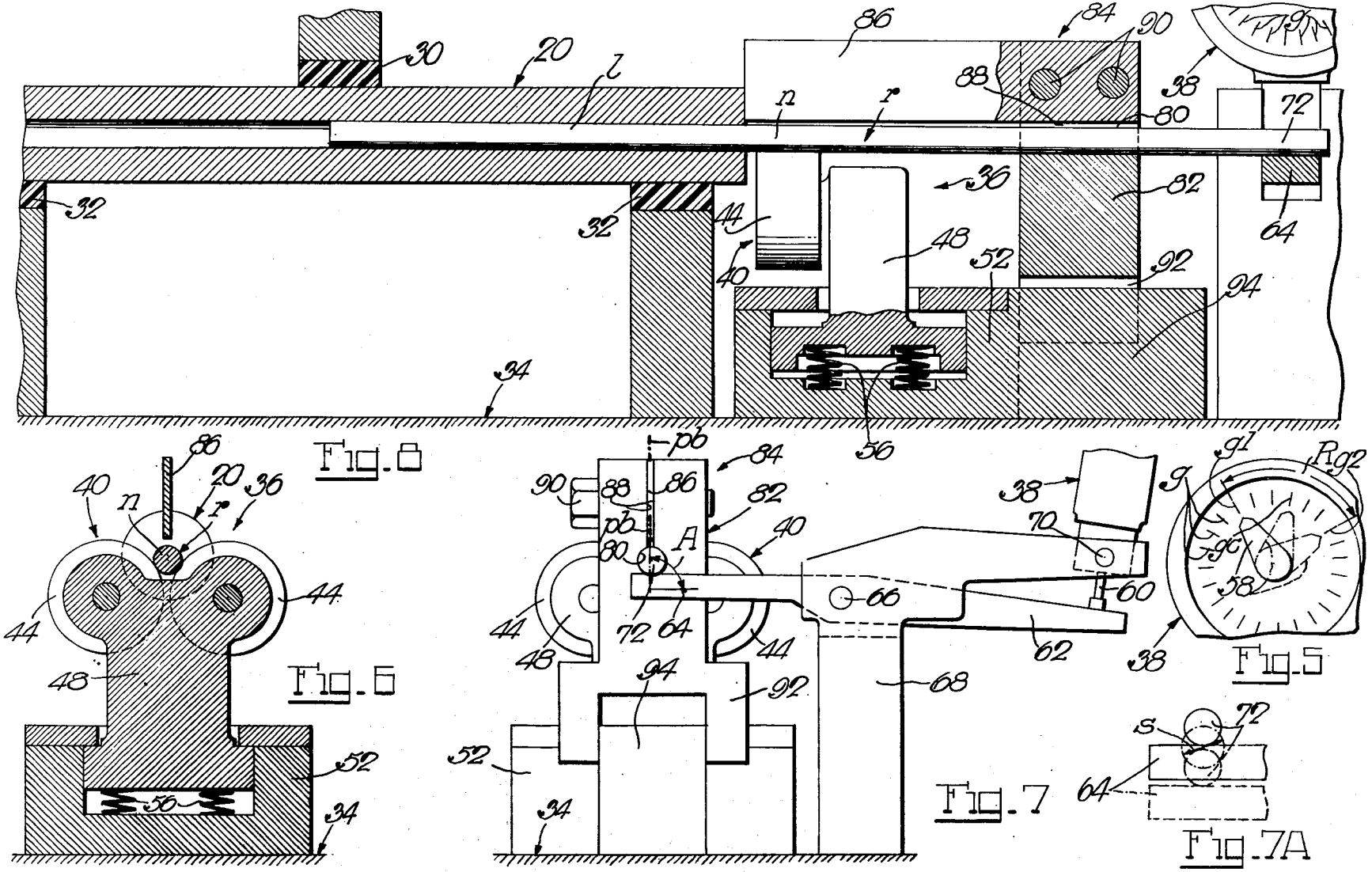
FIG. 5 is a fragmentary view of an instrument of the installation.
FIG. 6 is a section through the installation taken on the line 6—6 of FIG. 2.
FIG. 7 is a section through the installation substantially along the line 7—7 of FIG. 2.
FIG. 7A is an enlarged diagrammatic view of certain prominent elements of the installation in different cooperative positions.

The barrel support 36 provides front and rear bearings 40 and 42 (FIGS. 2,6 and 3,4) which are formed in this instance by pairs of associated rollers 44 and 46, respectively, on brackets 48 and 50 in blocks 52 and 54 on the base 34. The bearings 40 and 42 are with their brackets 48 and 50 depressible in the respective blocks 52 and 54 (FIG. 8) and urged by springs 56 into normal raised position (FIGS. 2,6 and 3,4). The associated rollers 44 and 46 of the front and rear bearings 40 and 42 form V-type supports for a barrel 20 at its respective front and rear ends, with the rear or butt end 24 of a barrel being placed into the V-support of the rear bearing 42 (FIGS. 3 and 4), and the front or muzzle end 26 of the barrel being held to the front bearing 40 through intermediation of the previously inserted rod *r* of which a projecting short piece *n* next to the muzzle end of the barrel is received in the V-support of the front bearing 40 (FIGS. 2 and 6). Thus, with the butt end 24 of the barrel being concentric with the bore and thereat and received in the V-support of the rear bearing 42, and with the rod insert r in the bore at the muzzle end of the barrel being received in the V-support of the front bearing 40, the bearings 40 and 42 support the barrel for rotation about the bore reference axis *x*, as will be readily understood.

The instrument 38 provides a dial with graduations *g* and a pointer 58 which is turned by a plunger 60 that bears against a finger 62 on a key 64 (FIGS. 2,5 and 7). The key 64 is at 66 pivoted on a bracket 68 on which the instrument 38 is suitably mounted as at 70 (FIG. 7), with the key being, by suitable spring action of the plunger 60 on the key finger 62, for example, urged into follower engagement with the outer end 72 of the rod part e which projects from the bearing-supported barrel 20 (FIGS. 2 and 7). Thus, and as explained earlier, the projecting rod end e on the supported barrel 20 in FIG. 2, for example, will move through a cone-shaped orbital path on turning the barrel while holding the rod against rotation, whereby the key 64 in follower relation with the rod end 72 will be displaced by the latter, for example, from the full-line position (FIG. 7A) when the barrel passes through the momentary angular position in FIG. 2B, to the dotted-line position (FIG. 7A) when the barrel passes through the momentary angular position in FIG. 2C. The key 64 thus displaced actuates the plunger 60 of the instrument to deflect the pointer 58, for example, from its full-line position (FIG. 5) which it assumes in the full-line key position in FIG. 7A, to its dotted-line position (FIG. 5) which it assumes in the dotted-line key position (FIG. 7A), with the exemplary graduation range R covered by the pointer 58 in its successive full-line and dotted-line positions reflecting the taper, as well as the deflection of the projecting rod end at the base *s*, of the orbital cone-shaped path C of the projecting rod part *e* and, hence, the extent of the run-out of the bore of the barrel 20. An operator will thus turn a barrel in the bearings while holding the inserted rod r against rotation, and make a mental note of the end graduations g1 and g2 of the exemplary graduation range R swept by the pointer 58 in the course of turning the barrel, with the operator knowing from experience the extent of the corrective bend in the barrel from the spread of the graduation range R on the instrument 38 (FIG. 5). The bending ram is actuated by the press on its downward work stroke with a preset force at which it will apply a permanent bend to a barrel when the same is backed against the anvils 32, with the operator turning a knob 76, for example, on the press 31 (FIG. 2), to adjust the downstroke of the ram 30 so that the remainder of its stroke following backup of the barrel on the anvils 32 will apply to the barrel the corrective bend of the extent selected by the operator in view of the pointer-swept graduation range noted by him on the indicator 38 (FIG. 5). Further, in taking note of the graduation range R on the indicator, the operator can, and should make a mental note of the center graduation gc of the graduation range for a check of the remaining, if any, run-out condition of the barrel bore following the application of the corrective bend to the barrel. Thus, if on such a check the pointer 58 should indicate the remaining run-out condition by aligning with the center graduation *gc*, the operator will know that the end length L of the barrel bore is in accurate alignment with the bore reference axis *x*, though deviation of the pointer to a permissible extent, for instance one graduation in either direction from the center graduation *gc*, would still indicate adequate straightening of the barrel for satisfactory firing accuracy of the barrel.

It has been pointed out that a bearing-supported barrel must be in the angular position in FIG. 2C for applying a corrective bend to the same on a downstroke of the ram 30. The indicator 38 is also adapted to indicate to the operator to stop rotation of a supported barrel when the same reaches the bending position in FIG. 2C. To this end, the key 64 is arranged to form a right angle A with the plane of reciprocation pb of the bending ram 30 when the key is in follower engagement with the end 72 of the projecting rod part e on a supported barrel (FIG. 7), with the key maintaining this right angle relation with the plane pb in any angular position of the barrel and, hence, being in its rod-following motion confined for all practical purposes to the plane pb owing to the short rod-following motions of the key at the usually slight run-out of barrel bores. With this arrangement, the key 64 reaches, in its rod-following motions in the plane *pb*, the opposite full-line and dotted-line end positions in FIG. 7A, for example, when the barrel passes through the exemplary angular positions in FIGS. 2B and 2C, respectively. Thus, the pointer 58 will be in its clockwise and counterclockwise endmost positions on the graduated instrument dial when the key is in its lowermost and uppermost line positions in FIG. 7A, for example. Accordingly, when an operator turns a bearing-supported barrel, he will stop rotation of the barrel when noting the pointer 58 of the instrument to reach an endmost position in clockwise direction, such as, for example, the dotted-line pointer position (FIG. 5), this being the pointer position when the supported barrel reaches substantially the angular bending position in FIG. 2C.

As has been pointed out, the projecting rod end *e* on a bearing-supported barrel is, during rotation of the latter, held against rotation for its motion response in a cone-shaped orbital path. To the end of holding the rod against such rotation, the same is at 80 clamped to a bracket 82 to form therewith a separate unit 84 which is to be applied to a barrel for its subjection to the explained test procedure. In applying the unit 84 to a barrel preparatory to its subjection to the test procedure, a length 1 of the rod r in front of a spacer bar 86 is inserted with a sliding fit into the bore 22 from the muzzle end of the barrel while the same is still out of the bearings 40 and 42, with the rod being thus inserted into the bore until the spacer bar 86 bears against the muzzle end 26 of the barrel. The spacer bar 86, which is part of the unit 84, is received in a slot 88 in the bracket 82 and clamped therein as at 90. The barrel with the applied unit 84 is next placed on the bearings 40,42 (FIGS. 2 and 3), and the bifurcated bottom 92 of the bracket 82 is projected over a widthwise reduced end 94 of the block 52 (FIG. 7) to thereby hold the rod r and, hence, the entire unit 84 against turning with the supported barrel when the latter is being turned by an operator.

To straighten a barrel, an operator will apply the unit 84 to the barrel by inserting the rod part 1 into the barrel bore from the muzzle end of the barrel until the spacer bar 86 abuts the muzzle end. The operator then places the barrel onto the bearings 40 and 42, with the butt end 24 of the barrel coming to rest on the rear bearing 42 (FIG. 3), and the part n of the projecting rod length e on the barrel coming to rest on the front bearing 40 (FIG. 2), thereby supporting the barrel for rotation about the bore reference axis *x*, with the operator also projecting the bifurcated bottom 92 of the bracket 82 over the part 94 of the block 52 to lock the rod r against rotation (FIG. 7). The operator will next turn the supported barrel, conveniently with the fingers of one hand, and watch the dial of the instrument 38 for successive maximum deflections of the pointer 58 in opposite directions that will indicate to him the graduation range swept by the pointer for his evaluation of the extent of the corrective bend in the barrel and according adjustment of the work stroke of the bending ram 30 at the exemplary knob 76 on the press 31 (FIG. 2). The operator will stop rotation of the barrel when the pointer 58 of the instrument reaches its extreme clockwise position, such as the dotted-line position in FIG. 5, for example, in which the supported barrel is in the correct angular position of FIG. 2C for applying the corrective bend thereto. The operator will next activate the press for a work stroke of the bending ram 30 in the course of which the ram will first depress the barrel with the applied unit 84 and the bearings 40 and 42 until the barrel comes to rest on the anvils 32 (FIG. 8), whereupon the ram will on its remaining descent apply the corrective bend to the barrel. On the following retraction of the ram 30, the bearings 40 and 42 will be spring-returned to their normal raised position (FIGS. 2 and 3) for removal therefrom of the barrel preferably after first testing the barrel with the instrument 38 for run-out, if any, of its bore over the relatively short endlength L thereof (FIG. 2). Straightening a barrel in the installation in accordance with the described method is quick and accurate and does not rely on a great deal of skill and experience of an operator, as will be readily understood.

Figures 3, 4, 9, 10, 11:
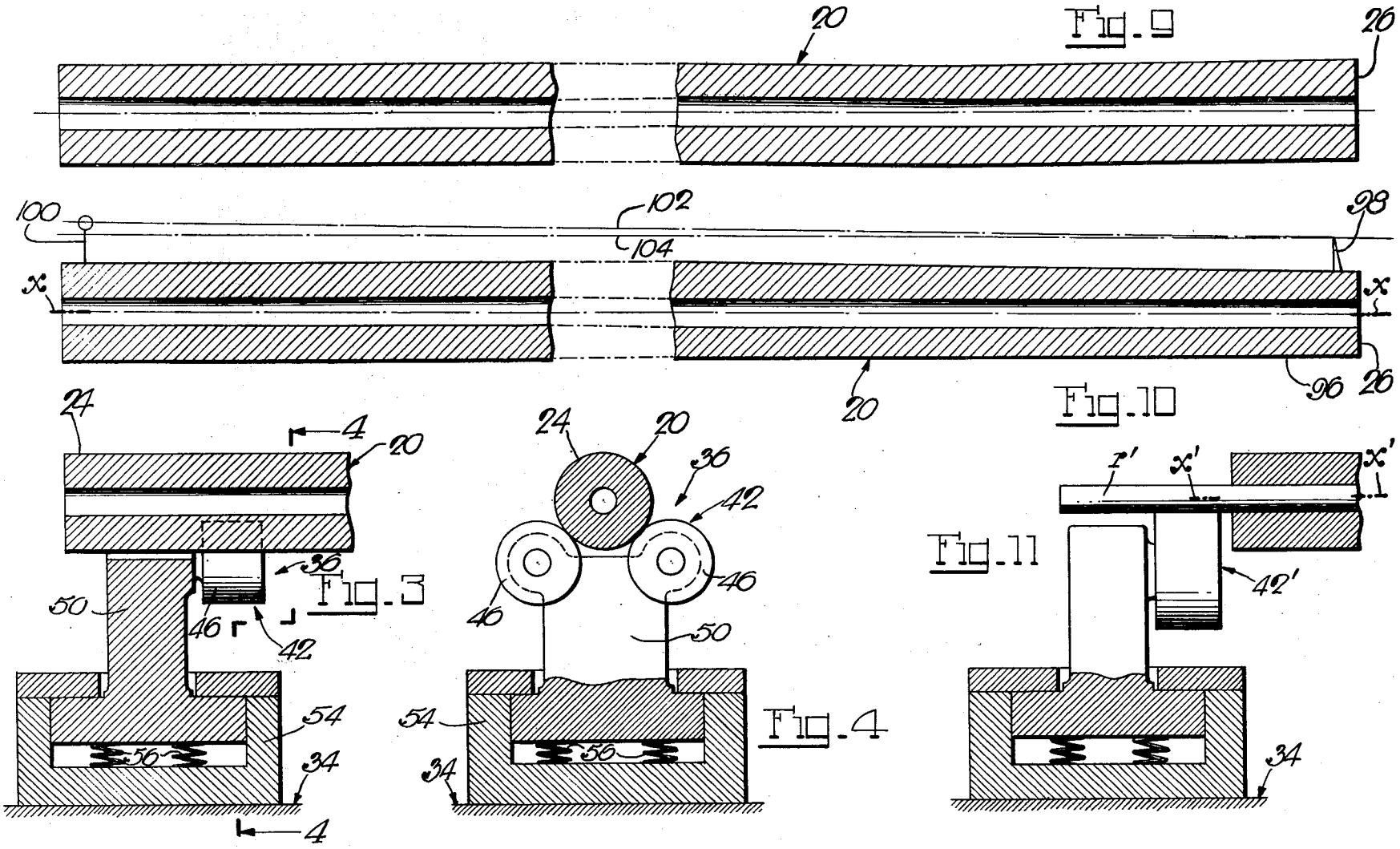
FIG. 3 is a fragmentary section through part of the installation which is omitted in FIG. 2.
FIG. 4 is a section through the installation taken on the line 4—4 of FIG. 3.
FIG. 9 is a fragmentary section through a barrel which has been straightened according to the method of the invention.
FIG. 10 is a fragmentary section through a barrel which has been straightened and provided with rear and front sights.
FIG. 11 is a fragmentary section through a part of an installation showing a modified step in the barrel straightening method of the invention.

The firing accuracy of a barrel thus straightened is usually determined by testing the same with accurately mounted front and rear sights. Since the mount of such sights on the outer periphery of a barrel is customarily predicated on bore ends which are concentric with the butt and muzzle ends of the barrel, and since the bore ends at the muzzle ends of the barrels are eccentric even after the latter have been straightened, it is imperative for accurate mounting of front sights to machine portions of the barrels to or near their muzzle ends to provide front sight mounts concentric with the bore ends at the muzzle ends of the barrels. Thus, a straightened barrel 20 with an eccentric bore at the muzzle end 26 (FIG. 9) is machined as at 96 at least over an endlength to and in this instance including the muzzle end 26 thereof (FIG. 10) so that the bore end at the muzzle end is now concentric with the barrel and the latter provides an accurate mount for a front sight 98 near the muzzle end. With the bores at the butt ends of the barrels being in this instance concentric with the barrels, the latter provide accurate mounts for rear sights 100 (FIG. 10). As usual, the sightline 102 established by the rear and front sights 100 and 98 deviates from a theoretical reference line 104 which extends parallel to the bore reference axis *x*, with the deviation of the sightline 102 from the reference line 104 compensating for the trajectory of fired projectiles.

Since the unit 84 is to be used with many identical barrels in straightening them, the rod *r* is resiliently flexible to some ectent, and the same is at least over the extent of its insertion into barrel bores slightly bent so that it will flex into snug sliding fit with barrel bores within existing permissible tolerances of their diameters without binding thereon.

If for any reason the bore ends of barrels should also be eccentric at the butt ends thereof, such barrels are straightened as explained hereinbefore, except that the bore at the butt end of such a barrel receives a slidingly fitting rod r' (FIG. 11) which is placed on the rear bearing 42' for the bearing support of the barrel at both ends for rotation about the bore reference axis *x'*.

What is claimed is:

1. Method of straightening firearm barrels of equal lengths with drilled bores of equal diameters, which comprises measuring the deviation of the center axis of the bore of each barrel from a straight reference axis at a single transverse barrel plane spaced less than half the length of the barrel from one barrel end, of which the reference axis passes through the centers of the opposite bore ends and the spacing of said transverse plane of each barrel from said one barrel end is the same for all barrels, and bending each barrel only at said transverse plane thereof to an extent gauged from the measured deviation thereat of said center axis from said reference axis and in a direction to bring said center axis at said barrel plane substantially into line with said reference axis.

2. The method of claim 1, in which said transverse plane of each barrel is spaced about one-fourth the length of the barrel from its muzzle end.

3. Method of straightening firearm barrels of the same lengths with drilled bores of the same diameters within permissible tolerances, which comprises providing a rod slightly bent for reception in a barrel bore with a sliding fit, inserting a length of the rod into the bore of a barrel from one end thereof to a depth which is level with a transverse barrel plane spaced less than half the barrel length from said one barrel end, while leaving a part of the rod projecting from said one barrel end, with said spacing of said transverse plane of each barrel from said one barrel end being the same for all barrels, turning the barrel about a straight reference axis which passes through the centers of the opposite bore ends while holding the rod against rotation with the barrel for motion response of the projecting rod part in a cone-shaped orbital path the taper of which indicates the extent of deviation of the center axis of the bore at said transverse barrel plane from said reference axis, and bending the barrel only at said transverse plane thereof to the indicated extent of the deviation thereat of said center axis from said reference axis and in a direction to bring said center axis at said transverse barrel plane substantially into line with said reference axis.

4. Method of straightening firearm barrels of the same lengths with drilled bores of the same diameters within permissible tolerances, which comprises providing a rod slightly bent for reception in a barrel bore with a sliding fit, inserting a length of the rod into the bore of a barrel from one end thereof to a depth which is level with a transverse barrel plane spaced less than half the barrel length from said one barrel end, while leaving a part of the rod projecting from said one barrel end with said spacing of said transverse plane of each barrel from said one barrel end being the same for all barrels, turning the barrel about a straight reference axis which passes through the centers of the opposite bore ends while holding the rod against rotation for motion response of the projecting rod part in a cone-shaped orbital path the taper of which indicates the extent of deviation of the center axis of the bore at said transverse barrel plane from said reference axis, and the axis of the cone of this path lying in a reference plane of the barrel in which also the projecting rod part lies, and bending the barrel only at said transverse plane thereof to the indicated extent of the deviation thereat of said center axis from said reference axis and in said reference plane of the barrel, to bring the bore axis at said transverse barrel plane substantially into line with said reference axis.

5. Method of straightening in an installation firearm barrels with bores concentric and eccentric at the butt and muzzle ends, with the installation providing rear and front V-bearings adapted to support a barrel for rotation about the hereinafter specified bearing axis, and a bending ram on one side of said axis and movable normal to said axis in a first plane in which the latter lies, with the ram being in operative alignment with a hereinafter specified transverse plane of a supported barrel, said method comprising inserting a slidingly fitting rod into a length of the bore of a barrel from the muzzle end to a transverse barrel plane spaced a predetermined distance of less than half the barrel length from the muzzle end and leaving a part of the rod projecting from the muzzle end, placing into the rear and front V-bearings the butt end of the barrel and a length of the projecting rod part next to the muzzle end of the barrel, respectively, for the support of the barrel for rotation about the bearing axis wich is also a bore reference axis of the supported barrel passing through the centers of the opposite bore ends, turning the supported barrel about said bearing axis while holding the rod against rotation for motion response of the projecting rod part in a cone-shaped orbital path of a taper which indicates the run-out of the bore over said length thereof, stopping rotation of the barrel in an angular position in which the projecting rod part lies in said first plane on the side of said bearing axis opposite to said one side thereof, and moving the ram through a work stroke to bend the barrel in said angular position thereof for bringing the bore axis at said transverse barrel plane substantially into line with said bearing axis while holding the barrel on opposite sides of said transverse barrel plane backed against yielding to the ram.

6. Method of straightening firearm barrels as in claim 5, of which the installation further provides an instrument with a pointer and a key, of which the key is movable normal to said bearing axis and in said first plane and is urged into follower relation with the projecting rod part on a supported barrel throughout its orbital movement, and the pointer is deflected by the key over a range proportional to the length of the key's follower motion in either direction in said first plane, with the pointer reaching the opposite first and second limits of said range when the projecting rod part passes in its orbital motion through said first plane on said one side and on the opposite side, respectively, of said bearing axis, with the supported barrel being stopped in its rotation in said angular position when the pointer is at said second limit of its deflection range.

7. The method of claim 6, in which the work stroke of the ram is variable and gauged from the range of the pointer deflection.

8. The method of claim 7, which further comprises inserting a slidingly fitting bar into the bore of a barrel from the butt end and leaving a stub end of the bar projecting from the butt end, and placing into the rear and front bearings the stub end of said bar and a length of the projecting rod part next to the muzzle end of the barrel, respectively, for the support of the barrel for rotation about said bearing axis.

9. The method of claim 7, in which the installation further provides anvils on said opposite side of said bearing axis between the bearings and on opposite sides of said transverse plane of a supported barrel, and the bearings are yieldable normal to said bearing axis and in said first plane toward the anvils for backing a supported barrel against the anvils and then bending the barrel on the work stroke of the ram.

* * * * *